US012269671B2

(12) United States Patent
Heukamp et al.

(10) Patent No.: US 12,269,671 B2
(45) Date of Patent: Apr. 8, 2025

(54) BEVERAGE CAPSULE

(71) Applicant: OBRIST CLOSURES SWITZERLAND, Reinach (CH)

(72) Inventors: Wolfgang Heukamp, Finnetrop (DE); Dirk Puderbach, Zell/Mosel (DE)

(73) Assignee: OBRIST CLOSURES SWITZERLAND, Reinach (CH)

( * ) Notice: Subject to any disclaimer, the term of this patent is extended or adjusted under 35 U.S.C. 154(b) by 439 days.

(21) Appl. No.: 17/251,569

(22) PCT Filed: Jun. 13, 2019

(86) PCT No.: PCT/EP2019/065625
§ 371 (c)(1),
(2) Date: Dec. 11, 2020

(87) PCT Pub. No.: WO2019/238898
PCT Pub. Date: Dec. 19, 2019

(65) Prior Publication Data

US 2021/0245950 A1 Aug. 12, 2021

(30) Foreign Application Priority Data

Jun. 13, 2018 (GB) ..... 1809708

(51) Int. Cl.
*B65D 85/80* (2006.01)
*B65D 85/804* (2006.01)

(52) U.S. Cl.
CPC ..... *B65D 85/8043* (2013.01); *B65D 85/8064* (2020.05)

(58) Field of Classification Search
CPC ..... B65D 85/8043; B65D 85/804; B65D 85/8046; B65D 85/8064
See application file for complete search history.

(56) References Cited

U.S. PATENT DOCUMENTS

| | | | | |
|---|---|---|---|---|
| 3,077,284 | A | 2/1963 | Mclaughlin | |
| 3,530,917 | A | 9/1970 | Donovan | |
| 3,721,367 | A | 3/1973 | Fletcher | |
| 3,795,182 | A * | 3/1974 | Van Damme ..... | B65D 85/8061 D7/400 |
| 4,847,148 | A | 7/1989 | Schirmer | |
| 4,935,089 | A | 6/1990 | Schirmer | |
| 5,012,928 | A | 5/1991 | Proffitt | |

(Continued)

FOREIGN PATENT DOCUMENTS

| | | |
|---|---|---|
| CA | 2586792 C | 2/2010 |
| CA | 2618863 C | 3/2011 |

(Continued)

OTHER PUBLICATIONS

Mexican Office Action for Mexican Patent App. No. MX/a/2017/08605 dated Feb. 5, 2021, BP-506 MX, 5 pages.

(Continued)

*Primary Examiner* — Ericson M Lachica
(74) *Attorney, Agent, or Firm* — Barnes & Thornburg LLP

(57) ABSTRACT

A perforable beverage capsule is provided and comprises a generally frustoconical body having a sidewall closed at one end by a piercable inlet wall through which hot water can be injected in use. The end of the sidewall opposite the inlet wall has a rim, and a sealing ring is provided.

19 Claims, 12 Drawing Sheets

(56) References Cited

U.S. PATENT DOCUMENTS 5,325,765 A 7/1994 Sylvan
5,840,189 A 11/1998 Sylvan
5,849,401 A 12/1998 El-Afandi
5,856,406 A 1/1999 Silvis
5,927,179 A 7/1999 Mordini
D438,794 S 3/2001 Miles
D452,433 S 12/2001 Lazaris
D452,434 S 12/2001 Sweeney
6,440,256 B1 8/2002 Gordon
D468,202 S 1/2003 Chou
D474,110 S 5/2003 Sweeney
D474,111 S 5/2003 Lazaris
6,589,577 B2 7/2003 Lazaris
6,607,762 B2 8/2003 Lazaris
6,645,537 B2 11/2003 Sweeney
6,655,260 B2 12/2003 Lazaris
6,810,788 B2 11/2004 Hale
D502,362 S 3/2005 Lazaris
6,884,450 B2 4/2005 Wu
D511,965 S 11/2005 Luc
D513,152 S 12/2005 Cahen
D515,970 S 2/2006 Hensen
D519,831 S 5/2006 de Cleir
7,105,106 B2 9/2006 Samuels
D546,672 S 7/2007 Chou
D551,909 S 10/2007 Eide
7,328,651 B2 2/2008 Halliday
D568,156 S 5/2008 Wilson
D570,650 S 6/2008 Vovan
D574,703 S 8/2008 Cassol
D577,288 S 9/2008 Wilson
D577,994 S 10/2008 Kessell
7,464,638 B2 12/2008 Tremblay
7,476,710 B2 1/2009 Mehta
7,531,198 B2 5/2009 Cortese
7,585,917 B2 9/2009 Datta
D606,363 S 12/2009 Aardenburg
D607,315 S 1/2010 George
D607,329 S 1/2010 Diss
7,662,885 B2 2/2010 Coffey
7,685,931 B2 3/2010 Rivera
D637,484 S 5/2011 Winkler
D638,290 S 5/2011 Cimmerer
D647,398 S 10/2011 Winkler
D647,399 S 10/2011 Winkler
D649,037 S 11/2011 Cimmerer
D649,054 S 11/2011 Sharma
8,053,051 B2 11/2011 Kitahara
8,067,501 B2 11/2011 Fiscus
D652,292 S 1/2012 Riales
8,173,747 B2 5/2012 Grein
D663,999 S 7/2012 Scrivani
8,252,351 B2 8/2012 Ozanne
D668,538 S 10/2012 Knutson
8,291,812 B2 10/2012 Rivera
8,361,527 B2 1/2013 Winkler
D675,519 S 2/2013 Knuston
8,409,676 B2 4/2013 Furneaux
D681,448 S 5/2013 Joseph
D686,916 S 7/2013 O'Brien
8,474,368 B2 7/2013 Kilber
D687,297 S 8/2013 O'Brien
8,522,669 B1 9/2013 Rolfes
D697,797 S 1/2014 Hansen
8,621,981 B2 1/2014 Rivera
D698,649 S 2/2014 Quint
D700,839 S 3/2014 O'Brien
8,685,479 B2 4/2014 Dogan
8,720,320 B1 5/2014 Rivera
D708,057 S 7/2014 Hansen
D710,686 S 8/2014 Gowens
8,794,125 B1 8/2014 Rivera
8,808,778 B2 8/2014 Dakis
8,828,895 B2 9/2014 Foss
D715,649 S 10/2014 O'Brien
D716,648 S 11/2014 Tan
D730,174 S 5/2015 O'Brien
9,085,410 B2 7/2015 Beer
D736,615 S 8/2015 O'Brien
D747,187 S 1/2016 Cochran
9,260,596 B2 2/2016 Kashiba
9,326,635 B2 5/2016 Koestring
9,415,913 B1 8/2016 Lanctuit
9,732,167 B2 8/2017 Okada
11,000,148 B2 5/2021 Conant
2002/0020659 A1 2/2002 Sweeney
2003/0222089 A1 12/2003 Hale
2004/0045443 A1 3/2004 Lazaris
2005/0051478 A1 3/2005 Karanikos
2005/0287251 A1 12/2005 Lazaris
2007/0098933 A1 5/2007 Opuszko
2007/0144356 A1 6/2007 Rivera
2010/0064899 A1* 3/2010 Aardenburg ..... A47J 31/3638 83/660
2010/0288131 A1 11/2010 Kilber
2010/0303964 A1 12/2010 Beaulieu
2011/0041702 A1 2/2011 Yoakim
2011/0064852 A1* 3/2011 Mann ..... B65D 85/8061 426/78
2011/0151075 A1 6/2011 Peterson
2011/0274802 A1 11/2011 Rivera
2012/0097602 A1 4/2012 Tedford
2012/0118166 A1 5/2012 Macchi
2012/0207895 A1 8/2012 Rivera
2012/0207896 A1 8/2012 Rivera
2012/0241352 A1 9/2012 Pramanik
2012/0276264 A1 11/2012 Rivera
2012/0308688 A1 12/2012 Peterson
2013/0059039 A1* 3/2013 Trombetta ..... B65B 29/022 99/295
2013/0061764 A1 3/2013 Rivera
2013/0064936 A1* 3/2013 Meelker ..... B65D 85/8043 426/112
2013/0068108 A1 3/2013 Rivera
2013/0101716 A1 4/2013 Beaulieu
2013/0122167 A1 5/2013 Winkler
2013/0129872 A1 5/2013 Marc
2013/0323129 A1 12/2013 Carmichael
2013/0323370 A1 12/2013 Gerbaulet
2013/0340626 A1 12/2013 Oh
2013/0344205 A1 12/2013 Oh
2014/0106036 A1* 4/2014 Cardoso ..... B65B 29/022 426/115
2014/0120217 A1 5/2014 O'Brien
2014/0120218 A1 5/2014 O'Brien
2014/0120288 A1 5/2014 Leser
2014/0141128 A1 5/2014 Trombetta
2014/0161937 A1 6/2014 Rondelli
2014/0178538 A1 6/2014 Husband
2014/0196608 A1* 7/2014 Amrein ..... B65D 85/8043 426/77
2014/0212546 A1 7/2014 Koestring
2014/0220191 A1 8/2014 Kelly
2014/0272018 A1* 9/2014 Koller ..... B65D 65/466 426/115
2014/0290493 A1 10/2014 Rivera
2014/0308405 A1 10/2014 Okada
2014/0308406 A1 10/2014 O'Brien
2014/0311098 A1 10/2014 Hooft
2014/0318380 A1* 10/2014 Doglioni Majer .... A47J 31/407 426/115
2014/0363655 A1 12/2014 Yoshida
2015/0191607 A1 7/2015 McDaniel
2015/0298897 A1* 10/2015 Kay ..... B65D 85/8043 426/115
2015/0314954 A1 11/2015 Empl
2015/0336736 A1 11/2015 Cabilli
2016/0016389 A1 1/2016 Dias
2016/0039601 A1* 2/2016 Doglioni Majer .... A47J 31/407 426/112
2016/0227957 A1 8/2016 Koestring
2016/0332805 A1* 11/2016 Krupa ..... B65D 65/466
2016/0355306 A1* 12/2016 Robin ..... B65D 17/4012

(56) References Cited

U.S. PATENT DOCUMENTS

| | | | | |
|---|---|---|---|---|
| 2017/0036854 | A1* | 2/2017 | Doglioni Majer | B65D 85/8049 |
| 2017/0042362 | A1* | 2/2017 | Bunner | B65D 21/0233 |
| 2017/0055761 | A1* | 3/2017 | Roberts | A47J 31/407 |
| 2017/0121050 | A1 | 5/2017 | Foster | |
| 2017/0266933 | A1 | 9/2017 | Lee | |
| 2017/0367521 | A1* | 12/2017 | Conant | B65D 1/265 |
| 2018/0001604 | A1 | 1/2018 | Van Loon | |
| 2018/0042258 | A1* | 2/2018 | Roberts | A47J 31/0615 |
| 2018/0079564 | A1* | 3/2018 | Darby | B65D 77/067 |
| 2018/0118450 | A1 | 5/2018 | Trombetta | |
| 2018/0228314 | A1 | 8/2018 | Putnam | |
| 2018/0334319 | A1 | 11/2018 | Cabilli | |
| 2019/0084759 | A1* | 3/2019 | Tung | B65D 85/8043 |
| 2019/0119036 | A1* | 4/2019 | Nordqvist | B32B 27/36 |
| 2019/0329969 | A1* | 10/2019 | Borse | B65D 85/8043 |
| 2021/0070537 | A1 | 3/2021 | Bunner | |
| 2021/0228017 | A1 | 7/2021 | Conant | |

FOREIGN PATENT DOCUMENTS

| | | | |
|---|---|---|---|
| CA | 2840141 | A1 | 12/2012 |
| CA | 2650797 | C | 5/2014 |
| CA | 2932176 | A1 | 6/2015 |
| ES | 1073281 | | 11/2010 |
| WO | 2012076135 | A1 | 6/2012 |
| WO | 2013132436 | A1 | 9/2013 |
| WO | 2014128315 | | 8/2014 |
| WO | 2015191565 | A1 | 12/2015 |
| WO | 2016174671 | | 11/2016 |
| WO | 2019238898 | A2 | 12/2019 |

OTHER PUBLICATIONS

International Search Report and Written Opinion for PCT/EP2019/065625 dated Jan. 9, 2020.

Office Action (Non-Final Rejection) dated Nov. 21, 2022 for U.S. Appl. No. 17/229,266, BP-506 US-CON || (pp. 1-11).

Office Action (Final Rejection) dated Sep. 8, 2022 for U.S. Appl. No. 17/099,081, BP-481 US-CON, (pp. 1-31).

Office Action (Final Rejection) dated May 2, 2023 for U.S. Appl. No. 17/229,266, BP-506, US-CON | (pp. 1-10).

Canadian Office Action for Canadian App. No. 2971930 dated Sep. 14, 2023, BP-506 CA, 4 pages.

Office Action (Non-Final Rejection) dated Oct. 17, 2023 for U.S. Appl. No. 17/099,081, BP-481 US-CON || (pp. 1-34).

Office Action (Non-Final Rejection) dated Sep. 27, 2024 for U.S. Appl. No. 17/229,266, BP-506 US-CON | (pp. 1-9).

Office Action (Final Rejection) dated May 10, 2024 for U.S. Appl. No. 17/099,081 (pp. 1-36).

Office Action (Final Rejection) dated Nov. 26, 2024 for U.S. Appl. No. 17/508,552 (pp. 1-7).

Braskem Regulatory Information Sheet for Inspire 6025N Polypropylene Resin, 12 pages.

Braskem information sheet for Inspire 6025N Polypropylene, 1 page.

Office Action dated Jun. 29, 2018 for U.S. Appl. No. 15/236,010 (p. 1-13).

Office Action dated Feb. 19, 2019 for U.S. Appl. No. 15/236,010 (pp. 1-15).

Office Action dated Aug. 6, 2019 for U.S. Appl. No. 15/631,236 (pp. 1-9).

Office Action dated Oct. 18, 2019 for U.S. Appl. No. 15/236,010, BP-481 US-U || , (pp. 1-16).

Office Action dated Feb. 4, 2020, for U.S. Appl. No. 15/631,236, BP-506 US-U || , (pp. 1-10).

Office Action dated May 15, 2020 for U.S. Appl. No. 15/236,010, BP-481 US-U|| (pp. 1-21).

Office Action (Non-Final Rejection) dated Jan. 24, 2022 for U.S. Appl. No. 17/099,081 (pp. 1-20).

* cited by examiner

Figure 17
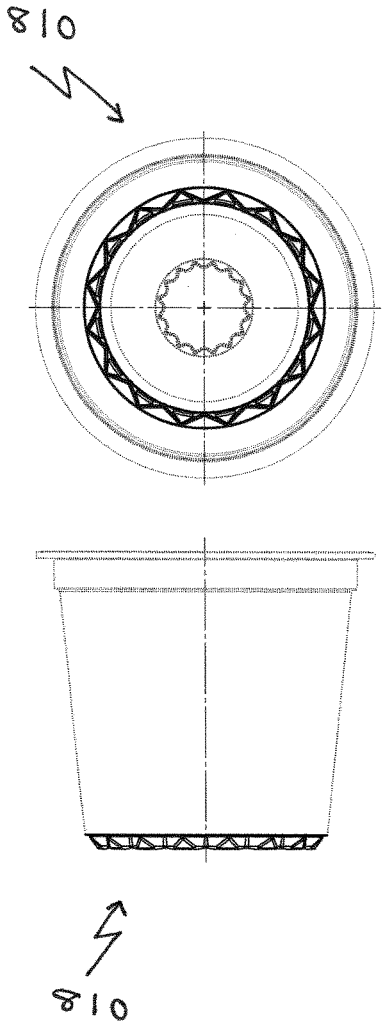
Figure 18
Figure 19
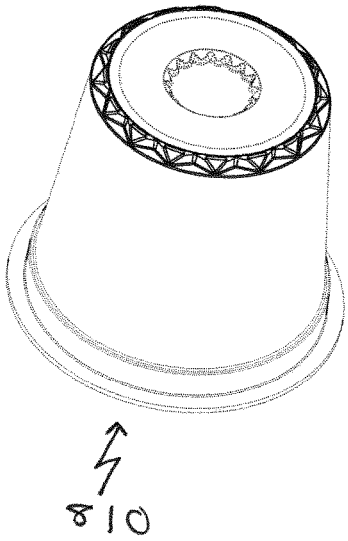
Figure 20
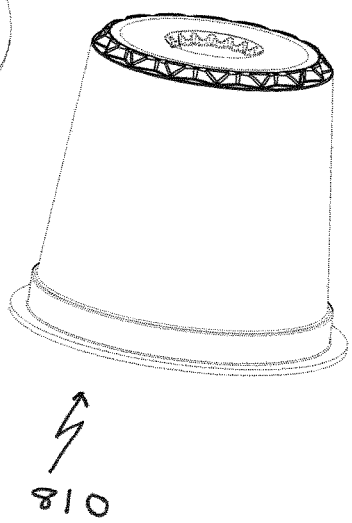

Figure 21
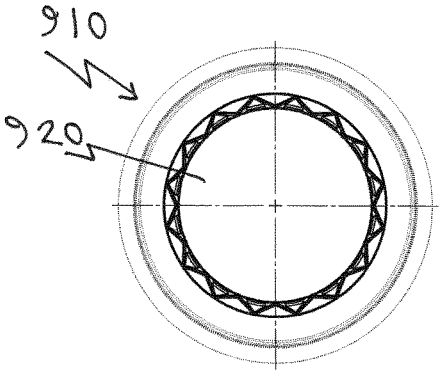
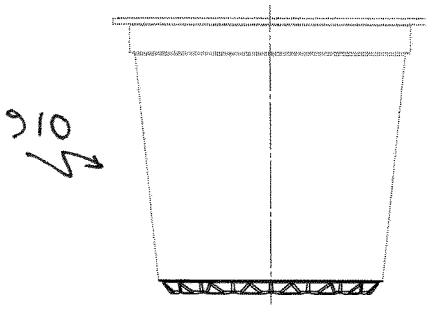
Figure 22
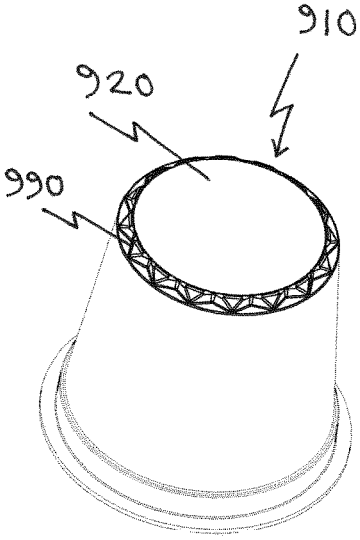
Figure 23
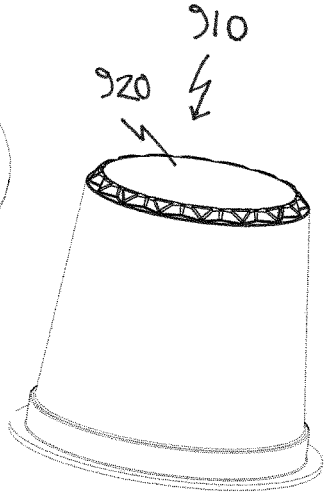
Figure 24

BEVERAGE CAPSULE

CROSS REFERENCE TO RELATED APPLICATIONS

This application is a U.S. national stage application under 35 U.S.C. § 371 (b) of International Application No. PCT/EP2019/065625 filed Jun. 13, 2019, which claims priority to United Kingdom Patent Application No. 1809708.9 filed on Jun. 13, 2018, the disclosures of both of which are hereby expressly incorporated by reference in their entirety.

The present invention relates generally to a capsule for use in the preparation of a beverage; for example a capsule for use in the preparation of tea or coffee contained in the capsule using hot water injected under pressure.

The present invention seeks to provide improvements in or relating to beverage capsules.

In some aspects the present invention provides or relates to a perforable beverage capsule comprising a generally frustoconical body having a sidewall closed at one end by bottom wall.

In some aspects the present invention provides or relates to a perforable beverage capsule comprising a generally frustoconical body having a sidewall closed at one end by a piercable inlet wall through which hot water can be injected in use.

The capsule may comprise a rim. A closure, such as a foil seal, may be applied over the rim e.g. to hermetically seal the contents of the capsule. The rim may comprise or include some means of improving sealing e.g. for sealing the closure and/or for sealing against components of a beverage making machine into which the capsule is inserted in use.

The piercable inlet wall or bottom wall may include a central "star like" structure to provide rigidity. Alternatively or additionally the perimeter of the bottom wall may be formed as a star or star-like structure.

The bottom wall and sidewall may be joined by a wall section which is formed by a plurality of facets or facet-like structures.

In one embodiment the bottom design includes a star structure for bottom rigidity.

A central, recess star-like structure may be provided. Alternatively or additionally the perimeter of the bottom wall may be formed as or include a star-like structure. A plurality of circumferentially distributed triangular (for example isosceles) shapes may form the star-like structures.

An aspect of the present invention provides a beverage capsule with a sealing ring formed from a foamed material.

In one aspect the present invention provides a perforable beverage capsule comprising a generally frustoconical body having a sidewall closed at one end by a piercable inlet wall through which hot water can be injected in use, the end of the sidewall opposite the inlet wall having a rim, and a sealing ring is provided.

A foil member or other form of closure may, for example, be sealed to the flange-like rim to close-off hermetically a cup-like body of the capsule.

The ring may provide an improved seal in use in a beverage making machine (such as a coffee pod machine) and/or during sealing of a closure across the rim.

The ring may be formed as a separate part which is joined or otherwise secured to the rest of the capsule.

The ring could be produced in various processes. E.g.:

punched out of plate of a foamed material.

being injected and foamed in the injection process sequential moulding with the body The sealing ring can be attached to each kind of capsule made out of each type of material.

The ring may be fitted against (for example "under" the rim). In some embodiments the rim is provided with a channel, gully, undercut or the like to receive the ring.

The ring may be a flat, disc-like annulus.

The rim end of the body may be sealed, for example with a foil liner or the like.

A further aspect provides a perforable beverage capsule comprising a generally frustoconical body having a sidewall closed at one end by a piercable inlet wall through which hot water can be injected in use, at least part of the body wall having a multi-faceted surface.

The faceting can be used to provide increased strength of the body and additionally can provided aesthetic benefits.

In some embodiments the sidewall comprises a plurality of generally triangular, contiguous facets.

Between the sidewall and the inlet wall an intermediate wall section may be provided. The intermediate wall section may be faceted.

The intermediate wall section may be inclined radially inwardly with respect to the sidewall.

In some embodiments the inlet wall may be generally convex, to provide a convex piercing zone.

The faceting may constitute the entire wall thickness, or a faceting surface may be provided on the interior and/or exterior face of a capsule wall.

Hollow facets may be provided only on the outside. This can be helpful when multiple capsules are stacked together, for example it can help to provide venting and avoid a vacuum when capsules are pulled apart.

The faceted body may be formed from a thermoplastics material.

Faceted wall structures may be used in conjunction with the sealing ring as described herein.

In some aspects and embodiments the capsule is formed as a barrier capsule, for example a barrier coffee capsule.

In some aspects and embodiments the capsule is formed from PP-EVOH-PP.

In some aspects the present invention provides or relates to a perforable beverage capsule comprising a generally frustoconical body having a sidewall closed at one end by a piercable inlet wall through which hot water can be injected in use, at the other end of the sidewall is a sealing rim.

The sealing rim may include a pattern, for example formed by raised surface formations. In one embodiment the pattern is at least partly non-repeating, for example R P C i.e. all units of the pattern are not the same e.g. R P C R P C R P C or R P C E S S E N T I A L, or R P C E S S E N T I A L R P C E S S E N T I A L.

The sealing area may be formed as an irregular shape, for instance substantially continuous lettering.

The rim pattern may provide an improved seal in use.

The present invention also provides a coffee capsule comprising a capsule as described herein.

The present invention also provides a pack comprising a plurality of capsules as described herein.

The capsule may be formed from a plastics material and formed by, for example, injection moulding, compression moulding, or thermoforming.

A further aspect provides a perforable beverage capsule comprising a generally frustoconical body having a sidewall closed at one end by a piercable inlet wall through which hot water can be injected in use, the end of the sidewall opposite the inlet wall having a rim, and a sealing ring is provided.

The sealing ring may be formed from a foamed material.

The sealing ring may be punched out of plate of a foamed material.

The sealing ring may be injected and foamed in an injection process.

The ring may be fitted against the rim.

The ring may be fitted under the rim.

The rim may be provided with a channel, gully, undercut or the like to receive the ring.

The ring may be a flat, disc-like annulus.

A further aspect provides a perforable beverage capsule comprising a generally frustoconical body having a sidewall closed at one end by a piercable inlet wall through which hot water can be injected in use, at the other end of the sidewall is a sealing rim, the sealing rim includes a pattern.

The pattern may be formed by raised surface formations.

The pattern may be at least partly non-repeating.

The pattern may include a plurality of units, in which units of the pattern are not all the same. Capsules may further comprise a sealing ring.

A further aspect provides a perforable beverage capsule comprising a generally frustoconical body having a sidewall closed at one end by a piercable inlet wall through which hot water can be injected in use, in which the piercable inlet wall includes a generally central star like structure to provide rigidity.

The structure may be an isotoxal star polygonal shape.

The perimeter of the bottom may be formed as a star or star-like structure, for example a generally isotoxal star polygonal shape.

A plurality of circumferentially distributed triangular shapes may form the star or star-like structures.

The sidewall may comprise a plurality of generally triangular, contiguous facets.

The inlet wall and the sidewall may be joined by a wall section which is formed by a plurality of facets or facet-like structures.

A further aspect provides a perforable beverage capsule comprising a generally frustoconical body having a sidewall closed at one end by a piercable inlet wall through which hot water can be injected in use, at least part of the body wall having a multi-faceted surface.

An intermediate wall section may be provided between the sidewall and the intermediate wall. The intermediate wall section may be faceted.

The intermediate wall section may be inclined radially inwardly with respect to the sidewall.

Faceting, where provided, may constitute the entire wall thickness. Alternatively or additionally one or more faceting surface/s may be provided on the interior and/or exterior face of the capsule wall.

The rim end of the body is sealed, for example by a foil liner or the like.

The capsule may be formed as barrier capsule.

The body may be formed from PP-EVOH-PP.

The present invention also provides a coffee capsule comprising a capsule as described herein.

The present invention also barrier beverage capsule.

The present invention also provides a barrier coffee capsule.

In capsules formed in accordance with the present invention the body may be formed from a plastics material.

The body may be formed by injection moulding, compression moulding, or thermoforming.

The present invention also provides a pack comprising a plurality of capsules as described herein.

Embodiments of the present invention are shown, by way of example, in the accompanying drawings.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

Referring first to FIGS. 1 and 2 there is shown a beverage capsule 10.

The capsule 10 comprises a generally frustoconical body having a sidewall 15 closed at one end by a piercable inlet wall 20 through which hot water can be injected in use.

The sidewall 15 comprises a plurality of generally triangular, contiguous facets 17, with alternating facets being oppositely oriented.

The inlet wall 20 and the sidewall 15 are joined by an intermediate wall section 25 which is formed by a circumferential array of a plurality of generally triangular, contiguous facets 19, with alternating facets being oppositely oriented.

The end of the sidewall opposite the inlet wall has a rim/flange 30 that projects radially outwards from the free end of the sidewall.

A separate sealing ring/disc 35 is provided. In this embodiment the ring 35 is formed from a foamed material.

The ring 35 is fixed to the rim 30. Fixation could be achieved, for example, by clamping, bonding or welding (e.g. heat or ultrasonic).

In FIG. 3 a rim 130 is provided with an undercut 132. The ring 135 is assembled into the undercut 132.

Production Steps:

1. Injection capsule (for example injection moulding of a plastics material)
2. Ring assembly
3. Filling
4. Sealing Production and ring assembly may be conducted in one assembly line.

In FIG. 4 sealing discs 235 are stamped from a sheet of material 237. In other embodiments discs are formed by injection or compression moulding.

FIGS. 5 to 12 shows a capsule 310 formed according to a further embodiment.

The capsule 310 is similar to the capsule 10, having a sidewall 315 closed at one end by a piercable inlet wall 320.

The sidewall 315 comprises a plurality of generally triangular, contiguous hollow facets 317, with alternating facets being oppositely oriented. In this embodiment there are thirty-two facets in total; sixteen in each longitudinal orientation. Other numbers of facets are possible.

The inlet wall 320 and the sidewall 315 are joined by an intermediate wall section 325 which is formed by a circumferential tooth-like array comprising a plurality of generally pyramidal, hollow, tri-faceted ridges 328 alternating with hollow tri-faceted rebates 329. In this embodiment there are sixteen triangular shapes and sixteen rebates which serve to reinforce the base against collapse during piercing. Other numbers of reinforcement shapes and rebates are possible.

The end of the sidewall opposite the inlet wall 320 has a rim/flange 330 that projects radially outwards from the free end of the sidewall.

The rim 330 includes a circumferential recess/channel 334 which can receive a sealing ring (not shown).

Radially inboard of the recess 334 is an annular raised surface formation pattern 340. In this embodiment the pattern is formed from a plurality of letters 342. The pattern is formed from a plurality of different letters and in this embodiment the pattern is non-repeating.

Figure 2:
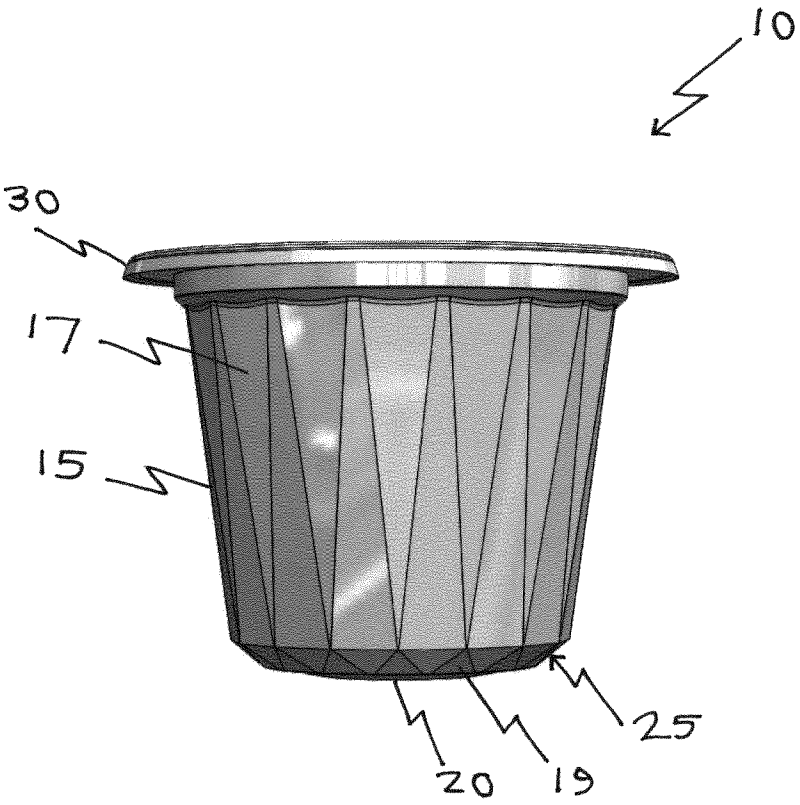
Figure 1:
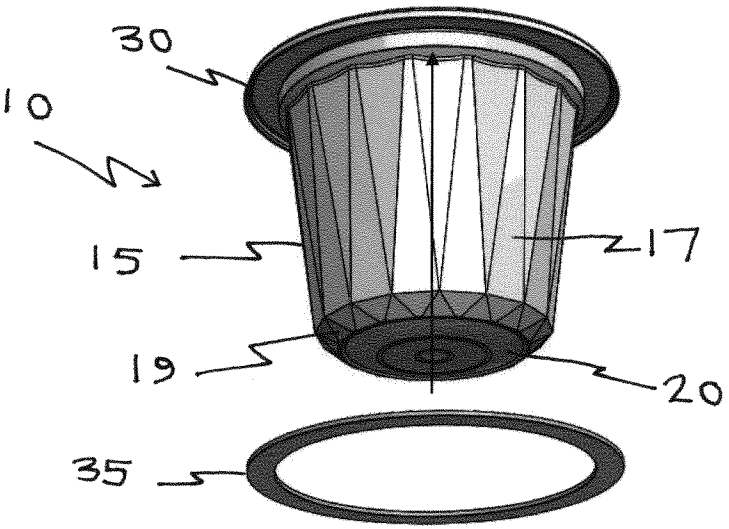
Figure 4:
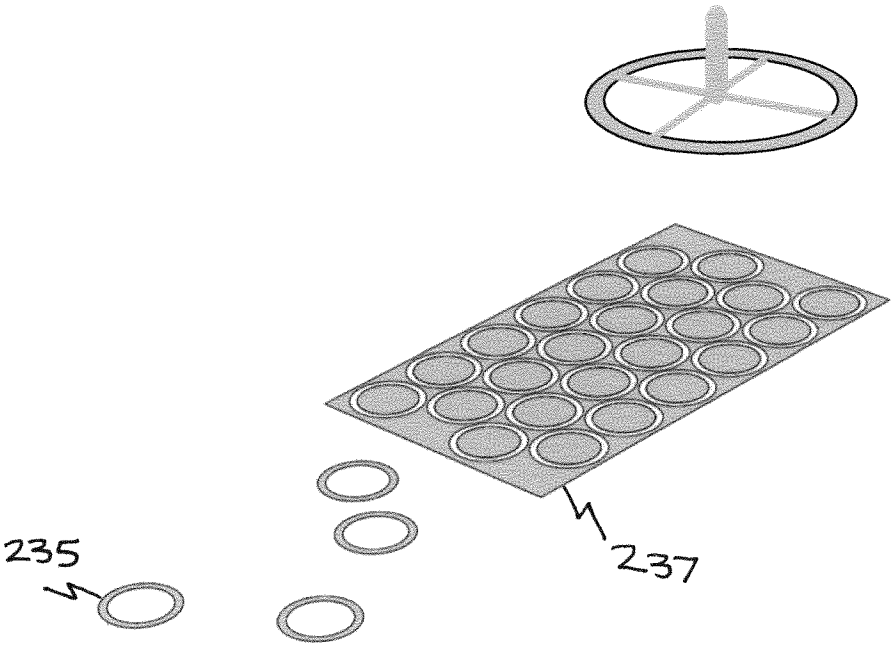
Figure 3:
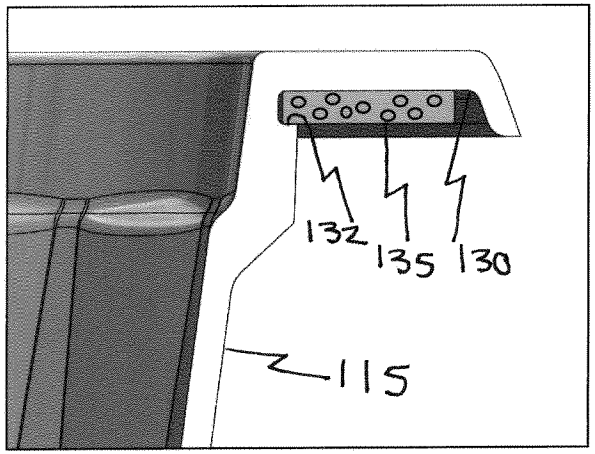
Figure 5:
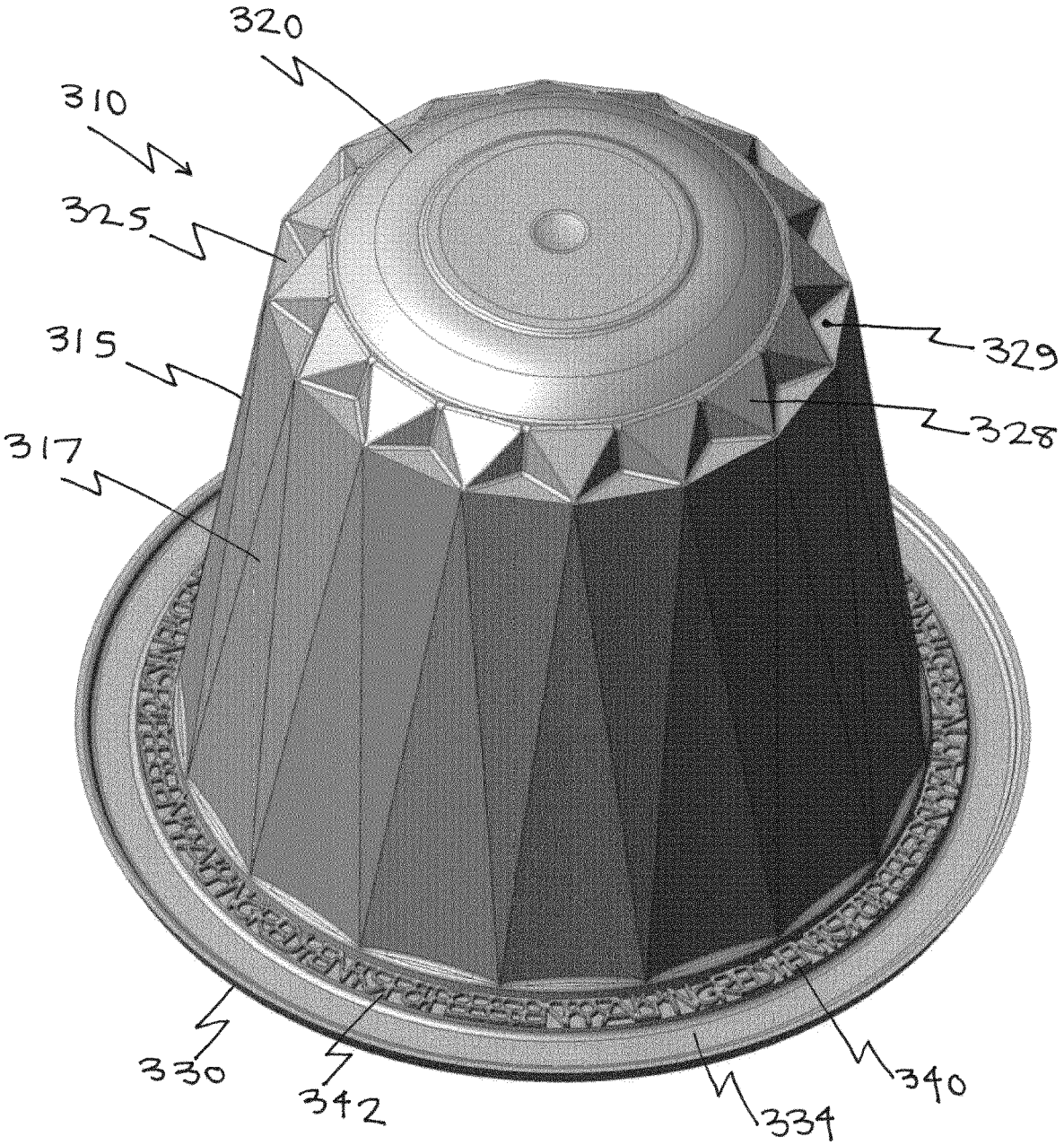
Figure 6:
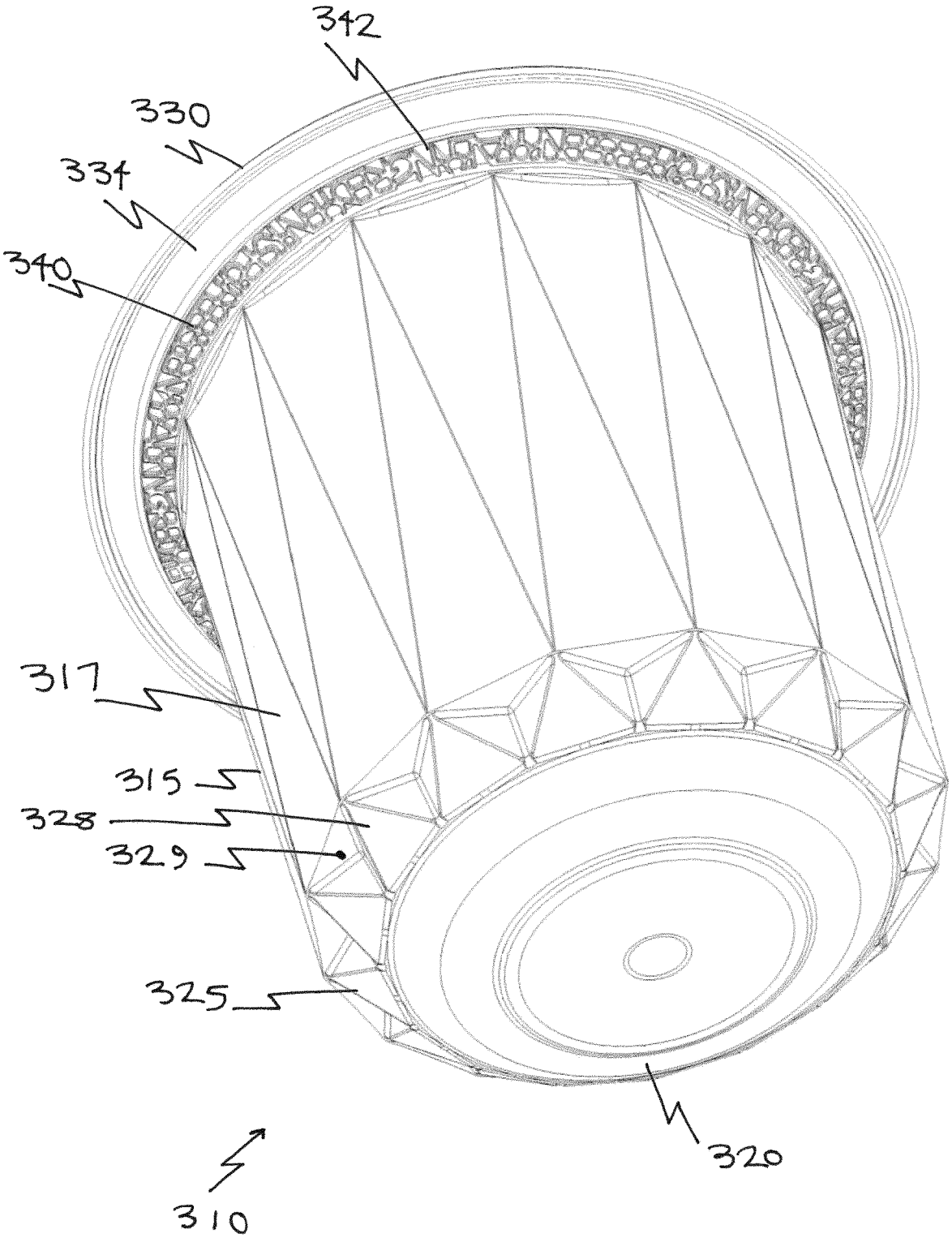
Figure 7:
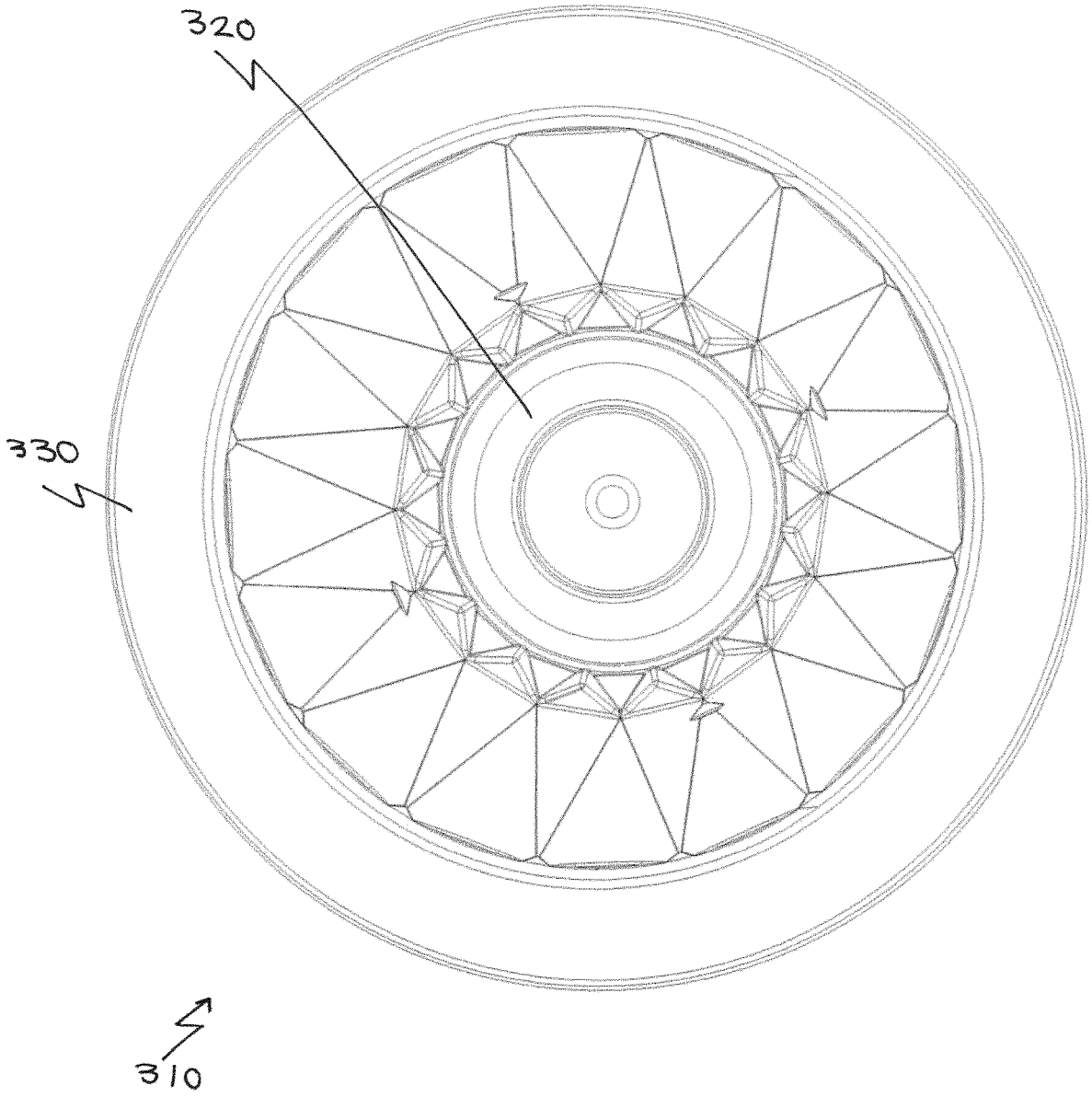
Figure 8:
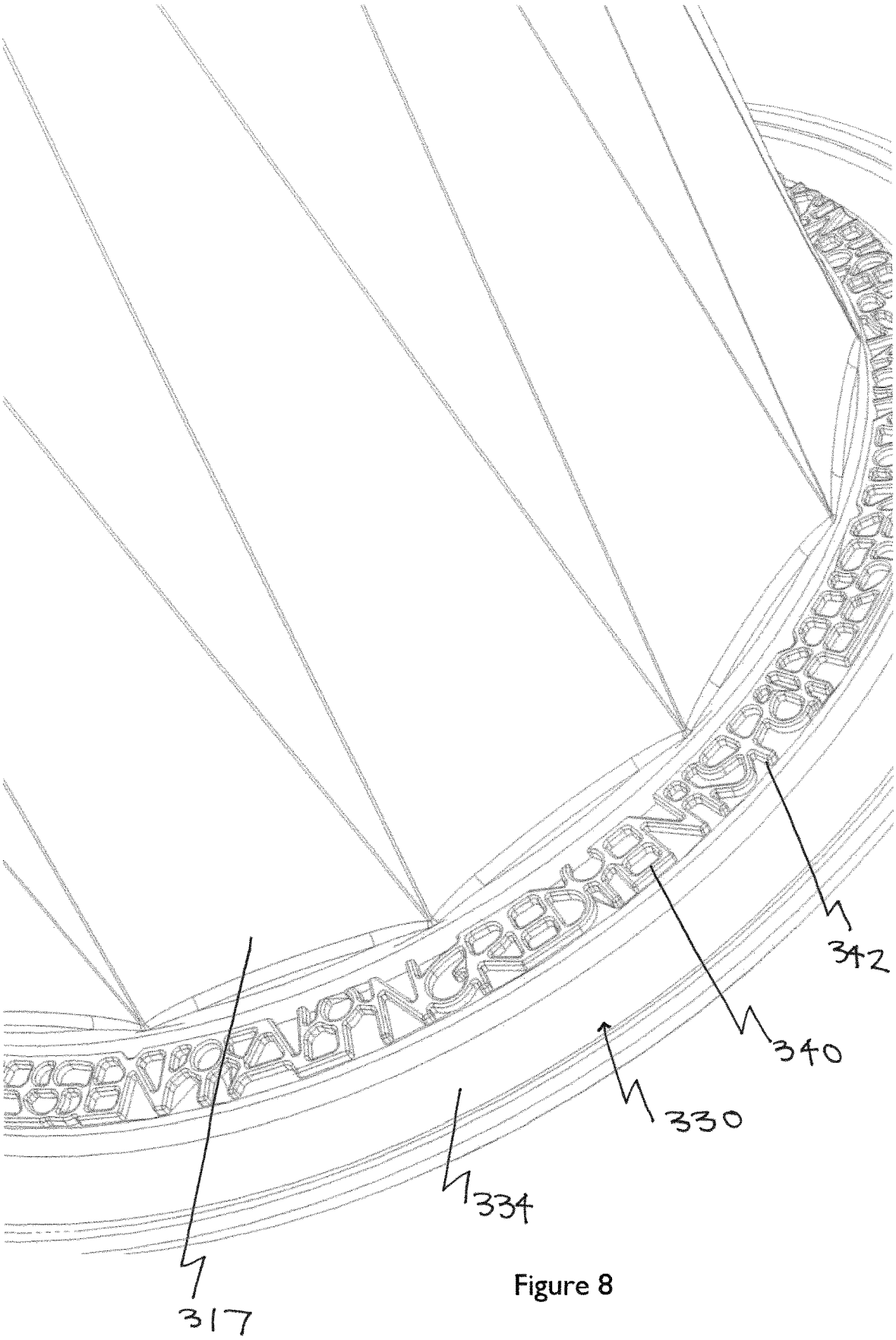
Figure 12:
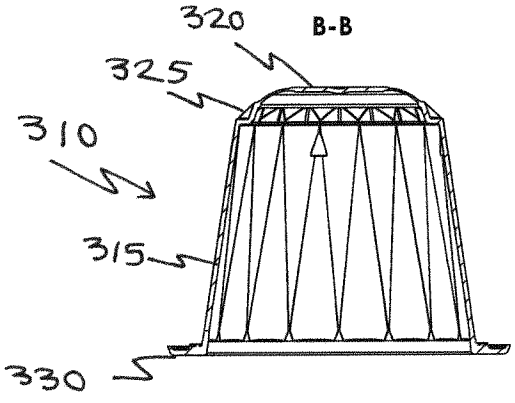
Figure 11:
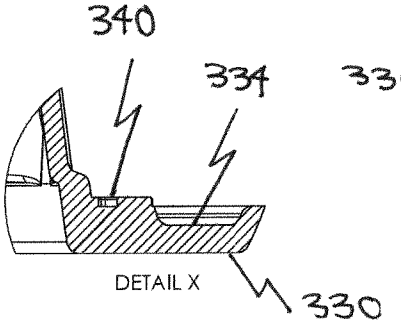
Figure 10:
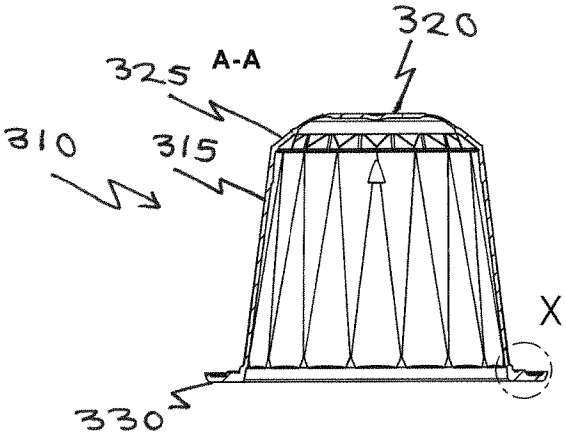
Figure 9:
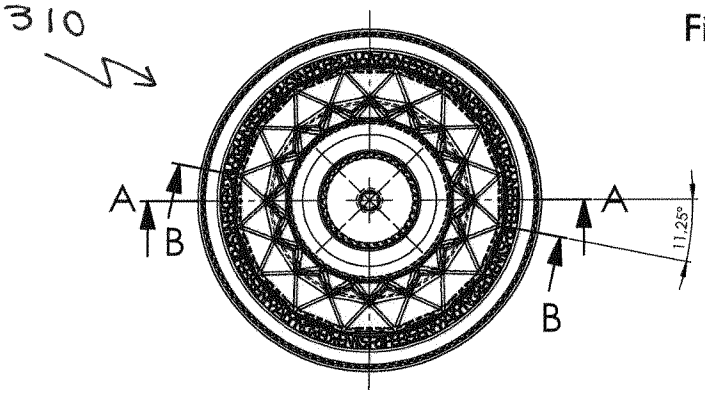
Figure 13B:
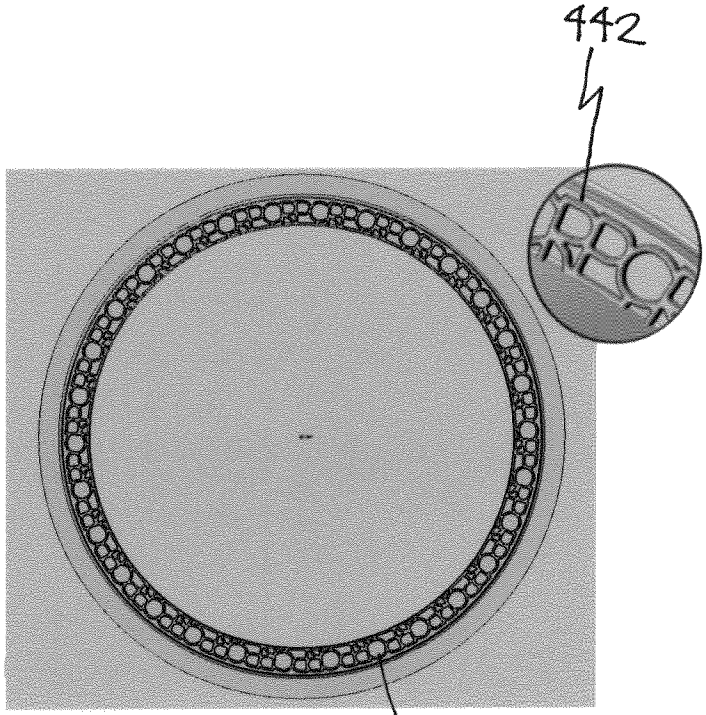
FIGS. 13A and 13B shows a magnified view of a further embodiment in which a repeating pattern 440 of three letters 442 is used (all letters in the circumferential array are therefore not the same).
Figure 13A:
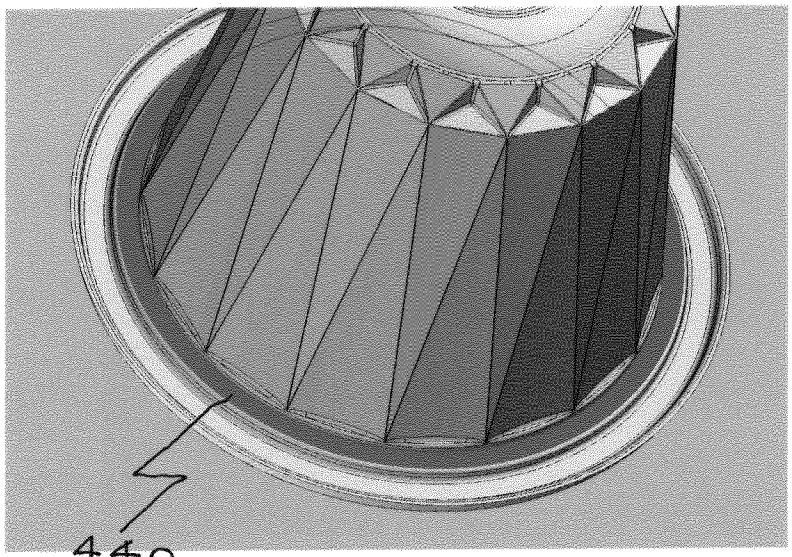
Figure 14:
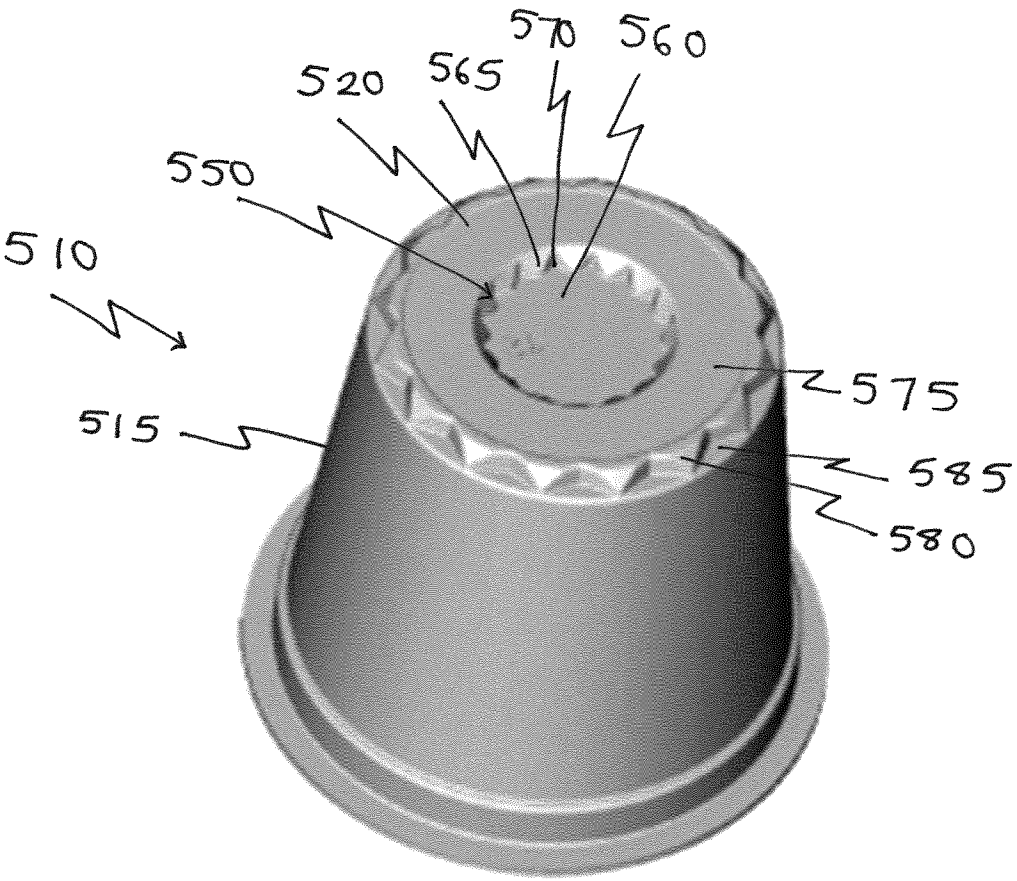
FIG. 14 shows a perforable beverage capsule 510 formed according to the present invention.

The capsule 510 comprises a generally frustoconical body having a sidewall 515 closed at one end by a piercable inlet wall 520 through which water or other fluid can be injected in use.

The generally disc-like piercable inlet wall 520 includes a generally central star like structure 550 to provide rigidity. The structure is an isotoxal star polygonal shape.

In this embodiment the perimeter of the bottom wall 520 is also formed as a star-like structure.

Moving from radially inwards to outwards, therefore, the bottom wall 520 comprises: a central recessed disc 560; a circumferential array of inwardly facing tri-faceted ridges/triangular castellations 565 alternating with tri-faceted rebates 570 surrounds the disc 560; an annulus 575; a circumferential array of outwardly facing tri-faceted ridges 580 alternating with tri-faceted rebates 585 surrounds the annulus 575.

In this embodiment the sidewall is generally smooth. In alternative embodiments the sidewall may comprise a plurality of facets, such as generally triangular, contiguous facets.

Figure 15:
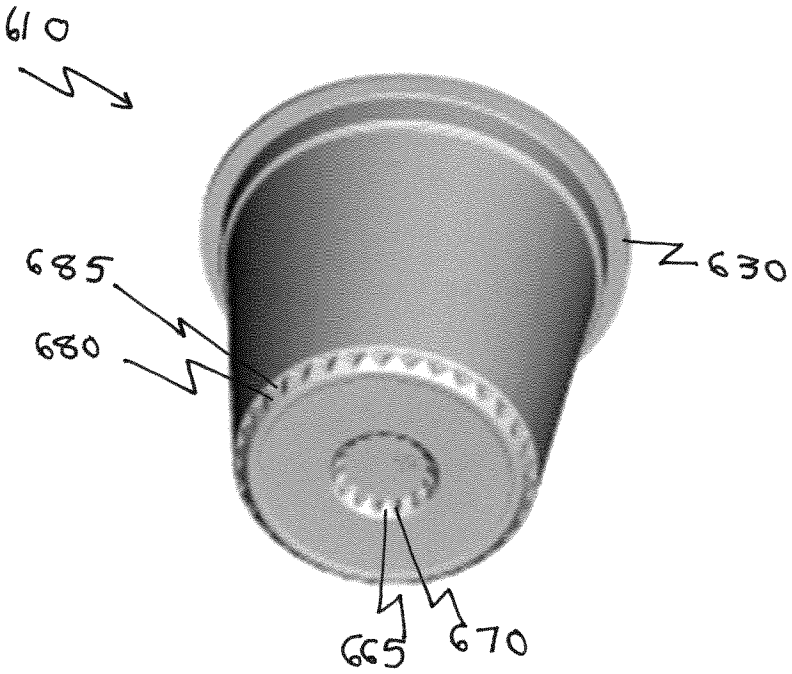

FIG. 15 shows a capsule 610 formed according to a further embodiment. The capsule is similar to the capsule 510 except that the central recessed disc 660 is smaller and the annulus 675 is larger. In addition there are more inwardly facing ridges 665 and rebates 670 and more outwardly facing ridges 680 and rebates 685.

Figure 16:
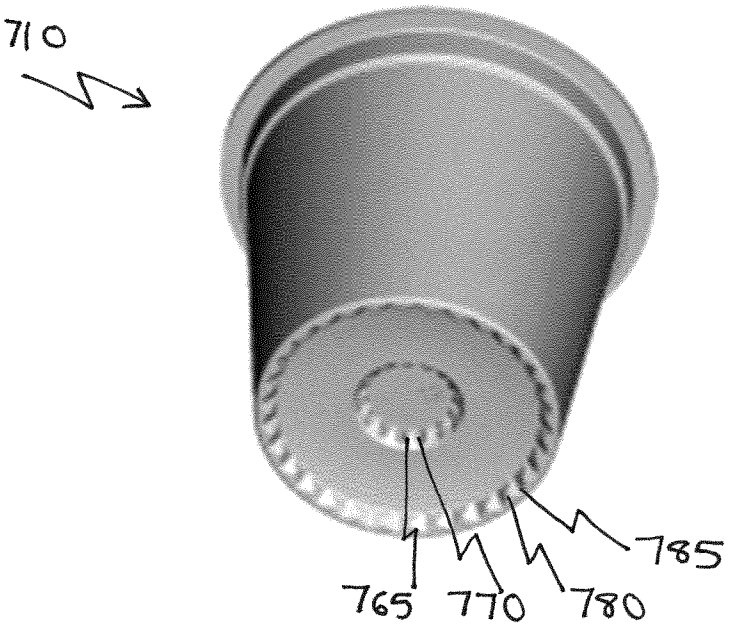

FIG. 16 shows a capsule 710 formed according to a further embodiment. The capsule 710 is similar to the capsule 610 except that the outer ridges 780 and rebates 785 are inwardly facing.

FIGS. 17 to 20 show a capsule 810 formed according to a further embodiment. The capsule 810 is similar to the capsule 610.

FIGS. 21 to 24 show a capsule 910 formed according to a further embodiment. In this embodiment there is no central recessed disc; the inlet wall 920 has a generally flat central disc surrounded by a peripheral annular belt of triangular castellations 990.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A perforable beverage capsule comprising a generally frustoconical body having a sidewall closed at one end by a piercable inlet wall through which hot water can be injected in use, an intermediate wall joining the sidewall and the piercable inlet wall, wherein the piercable inlet wall includes a generally central disc and the intermediate wall includes a first circumferential array of generally triangular contiguous facets surrounding the generally central disc, wherein the sidewall is formed by a second circumferential array of generally triangular, contiguous facets with alternating facets being oppositely oriented, wherein facets included in the second circumferential array of generally triangular, contiguous facets of the sidewall share vertices with facets included in the first circumferential array of generally triangular, contiguous facets of the intermediate wall, and wherein the facets included in the second circumferential array of generally triangular, contiguous facets of the sidewall have linear side edges.

2. The perforable beverage capsule of claim 1, wherein each of the first circumferential array of generally triangular contiguous facets of the intermediate wall provides an isotoxal star polygonal shape.

3. The perforable beverage capsule of claim 2, wherein the first circumferential array of generally triangular contiguous facets includes isosceles triangles.

4. The perforable beverage capsule of claim 1, wherein the perforable beverage capsule further comprises a rim.

5. The perforable beverage capsule of claim 4, wherein a closure is applied over the rim.

6. The perforable beverage capsule of claim 5, wherein the closure is a foil seal.

7. The perforable beverage capsule of claim 1, wherein the first circumferential array of generally triangular contiguous facets of the intermediate wall includes faceted ridges alternating with faceted rebates.

8. The perforable beverage capsule of claim 1, wherein each neighboring facet included in the generally triangular contiguous facets of the intermediate wall is oppositely oriented relative to one another.

9. A perforable beverage capsule comprising a generally frustoconical body having a sidewall closed at one end by a piercable inlet wall through which hot water can be injected in use, and an intermediate wall coupled between the sidewall and the piercable inlet wall, wherein the piercable inlet wall comprises a generally central disc and the intermediate wall is formed by a plurality of generally pyramidal, hollow, tri-faceted ridges alternating with hollow tri-faceted rebates, wherein the sidewall is formed by a circumferential array of generally triangular, contiguous facets with alternating facets being oppositely oriented, and wherein facets of the sidewall share vertices with each of the tri-faceted ridges of the intermediate wall.

10. The perforable beverage capsule of claim 9, wherein the plurality of tri-faceted ridges provides an isotoxal star polygonal shape.

11. The perforable beverage capsule of claim 10, wherein the isotoxal star polygonal shape includes isosceles triangles.

12. The perforable beverage capsule of claim 9, wherein the perforable beverage capsule further comprises a rim.

13. The perforable beverage capsule of claim 12, wherein a closure is applied over the rim.

14. A perforable beverage capsule comprising a generally frustoconical body having a sidewall closed at one end by a piercable inlet wall through which hot water can be injected in use, wherein the piercable inlet wall includes a generally central disc, and an intermediate wall surrounding the generally central disc, the intermediate wall is formed of generally triangular contiguous facets alternating with generally triangular shaped rebates, wherein the sidewall is formed by a circumferential array of generally triangular, contiguous facets, wherein each of the generally triangular, contiguous facets of the sidewall share a vertex with a corresponding facet included in the intermediate wall, and wherein each of the generally triangular, contiguous facets of the sidewall is planar.

15. The perforable beverage capsule of claim 14, wherein the generally triangular contiguous facets of the intermediate wall provide an isotoxal star polygonal shape.

16. The perforable beverage capsule of claim 15, wherein the isotoxal star polygonal shape includes isosceles triangles.

17. The perforable beverage capsule of claim 14, wherein the perforable beverage capsule further comprises a rim.

18. The perforable beverage capsule of claim 17, wherein a closure is applied over the rim.

19. The perforable beverage capsule of claim 18, wherein the closure is a foil seal.

* * * * *